US007293895B2

(12) United States Patent
Grossman et al.

(10) Patent No.: US 7,293,895 B2
(45) Date of Patent: Nov. 13, 2007

(54) MODULAR LIGHTING SYSTEM AND METHOD OF INSTALLATION

(75) Inventors: Steven H. Grossman, Gaithersburg, MD (US); Richard E. Grossman, Gaithersburg, MD (US)

(73) Assignee: Cathode Lighting Systems, Inc., Gaithersburg, MD (US)

( * ) Notice: Subject to any disclaimer, the term of this patent is extended or adjusted under 35 U.S.C. 154(b) by 0 days.

(21) Appl. No.: 11/253,712

(22) Filed: Oct. 20, 2005

(65) Prior Publication Data

US 2007/0091596 A1 Apr. 26, 2007

(51) Int. Cl.
*F21S 4/00* (2006.01)

(52) U.S. Cl. ..... 362/219; 362/147; 362/217; 362/221; 362/225; 362/260; 174/110 R; 174/113 R

(58) Field of Classification Search ..... 362/147, 362/217, 219, 221, 225, 260; 174/110 R, 174/113 R See application file for complete search history.

(56) References Cited

U.S. PATENT DOCUMENTS

| | | | | |
|---|---|---|---|---|
| 1,863,347 | A * | 6/1932 | Murphy | 174/116 |
| 4,967,324 | A * | 10/1990 | Barclay | 362/147 |
| 5,221,139 | A | 6/1993 | Belfer | |
| 5,226,724 | A * | 7/1993 | Kanarek | 362/260 |
| 5,448,460 | A | 9/1995 | Belfer et al. | |
| 5,452,187 | A | 9/1995 | Belfer et al. | |
| 5,564,818 | A * | 10/1996 | Grossman et al. | 362/221 |
| 5,640,069 | A * | 6/1997 | Nilssen | 315/209 R |
| 5,755,507 | A | 5/1998 | Hucks | |
| 5,902,962 | A * | 5/1999 | Gazdzinski | 174/113 R |
| 6,186,642 | B1 | 2/2001 | Corcorran et al. | |
| 6,318,884 | B1 * | 11/2001 | Hibbard et al. | 362/391 |
| 6,454,431 | B1 * | 9/2002 | Grossman et al. | 362/151 |
| 6,773,130 | B1 * | 8/2004 | Richardson | 362/92 |
| 2004/0020686 | A1 * | 2/2004 | Alfonso Perez et al. | 174/155 |
| 2005/0092971 | A1 * | 5/2005 | Easter | 252/500 |

OTHER PUBLICATIONS

"System BNP: Standard-Output Ballast-Operated Cold Cathode," Cathode Lighting Systems Inc., 2002 (Catalog Excerpt, 1 page).

(Continued)

*Primary Examiner*—Stephen F. Husar
*Assistant Examiner*—Meghan K. Dunwiddie
(74) *Attorney, Agent, or Firm*—Dickstein Shapiro LLP

(57) ABSTRACT

A modular lighting system is formed of tubular fluorescent lamps mounted within adjustable fixtures. The fixtures are composed of rigid and flexible elements and can conform to the shape of almost any size or shape of lamp. The lamps may be of any variety of pre-determined shape, curvature or length, to meet the desired lighting requirement. Each fixture may include a lampholder, lamp retention device, mounting surface, ballast, enclosures, and specially-molded flexible special power cable which flexibly connects the rigid elements or assemblies of each fixture. Electrical connections are made between each adjacent fixture with integral male and female flexible power cords. Thus, a custom-made fluorescent lighting system is created using standardized flexibly adjustable fixtures and any variety of lamp shapes or lengths. The system may be installed and electrically connected without any disassembly or tradition field-assembled and installed wiring, minimizing effort for installation or removal.

22 Claims, 16 Drawing Sheets

OTHER PUBLICATIONS

"Cathode Light Strip; Single-Lamp Modular Cold Cathode Fluorescent Fixture," Cathode Lighting Systems Inc., 2002 (Brochure, 4 pages).

TruFlex System Pamphlet, "Making Cold Cathode Simple," Innovative Lighting (2 pages).

"Seamlessline: T6 fluorescent," NIPPO Electric Co., Ltd., 2003 (Brochure, 4 pages).

"Six easy steps to install Finelite," Installation Instructions (Catalog Excerpt, 2 pages).

"Linear T8 Fluorescent," bartcoLIGHTING, 2003, p. A-53 (Catalog Excerpt, 1 page).

"High Power Fluorescent Lamps," Zhejiang Super Lighting Electric Appliance Co., Ltd. (2 pages).

"Field Curveable 'FX Series' Light Strip," Norbet Belfer Lighting, p. 3 (Catalog Excerpt, 1 page).

"Seamless Design System," Belfer, pp. 6-9, 33 (Catalog Excerpt, 5 pages).

* cited by examiner

MODULAR LIGHTING SYSTEM AND METHOD OF INSTALLATION

FIELD OF THE INVENTION

The present invention relates to a modular, field-adjustable, linear lighting system in which one fixture universally accepts almost any size or shape of prefabricated tubular lamp.

BACKGROUND OF THE INVENTION

Traditionally, tubular fluorescent lighting products which are utilized to provide a continuous uninterrupted line of light for both curved and straight lighting applications can be separated into three categories:

1). Fixtures and systems which use standardized straight tubular lamps in novel ways (either by overlapping, staggering or angling) to both navigate curved and straight architectural details, and overcome the problems created by the non-illuminated lamp end(s).

2). Fixtures and systems which utilize straight tubular lamps (e.g., butt-ended cold cathode fluorescent lamps) which, through their unique construction, do not exhibit the typical non-illuminated lamp end(s), thus providing continuous even illumination from one end of the lamp body to the other, allowing end-to-end installation. These straight lengths are configured in various ways, e.g., angled or overlapped to conform to curved and/or straight architectural requirements.

3). Fixtures and systems which utilize the uniquely constructed lamps described in the paragraph above in which the lamps may also be made as custom or standardized straight, bent or custom-curved elements that can conform to almost any architectural or design requirement.

Examples of systems which utilize standardized straight tubular lamps and fixtures described in category #1 would include a simple staggered fluorescent fixture, such as the one currently manufactured by Bartco. The non-illuminated ends of the lamp are compensated by overlapping the tubular lamp body. This type of system could be used for straight or very gently curved applications, the length of the standardized lamp determining the minimum radius on which they can be installed. Systems which utilize a staggered lamp configuration suffer from overly bright areas of illumination where the lamps overlap, and can produce a pattern of alternating brightness when the fixtures are used in an indirect application. Additionally, because the lamps are configured side-by-side, and not in a true linear array, even the untrained eye can see that the surfaces closest to each lamp are more brightly illuminated than those even slightly farther away. That is, where tubular lamps are staggered side by side, the cove will exhibit uneven light distribution. The lamps closest to the back of the cove will create a lower-brightness light pattern at the front of the cove, and lamps closest to the front of the cove will produce a lower-brightness light pattern at the back of the cove.

Some manufacturers utilize smaller biax or compact-fluorescent lamps in an overlapping or non-overlapping placed array. In the case of this type of lamp, only one end of the lamp is not illuminated. This type of lamp is essentially a "U" shaped tubular fluorescent that has an exceedingly small area in which the lamp returns on itself, giving it the appearance of twin lamps, side by side. To conceal the non-illuminated portion of the lamp that accommodates the lamp base, these lamps can be mounted in an overlapping fashion in which the illuminated end of one lamp conceals the non-illuminated end of the adjacent lamp. These lamps can be installed on fixtures that are either straight, semi-flexible, or segmented with a swiveling feature, allowing the fixture itself to be field-curved to the desired shape. Examples of this type of fixture are manufactured by Belfer, Inc. Each lamp is attached either at a tangent to a semi-flexible curvable element or to a curvable, swiveling, segmented element. The curvable elements are designed to accommodate a plurality of straight, small lamps and usually contain the power supplies which operate the lamps. The disadvantages of the above-referenced system are that the non-overlapping lamp configuration exhibits dark spots and shadowing between the lamps, and the overlapping system is not as maximally efficient due to the relatively high lamp quantities and corresponding high wattage densities required by the overlapping feature.

Examples of systems that utilize straight tubular lamps and fixtures described in category #2 would include a cold cathode fluorescent lighting system shown in U.S. Pat. No. 6,454,431, incorporated herein by reference. There, a lighting system having self-contained aluminum-extrusion fixtures accept a variety of standardized lamp lengths. The standardization of the fixture and lamp sizes minimizes manufacturing and project design expenses. The lamps are uniquely constructed to provide uniform illumination from one end of the lamp to the other. The lamp base and cathode that would normally create a non-illuminated space at each end of the lamp has been moved behind and underneath the lamp, allowing continuous illumination at each end of the lamp body. The fixtures, and correspondingly, the lamps, may be arranged end-to-end, producing a continuous shadow and gap-free line of light. To transition slight curvatures, fixtures can be installed at angles to one another. Depending upon the radius required and the most minimal lamp length, a limited variety of very large gentle radii can be accommodated. Smaller radii and complex curvilinear shapes cannot be accommodated. This is an inherent disadvantage of the system. It is not offered as a curved or bent fixture that could accommodate curved or bent lamps needed for more complex and curved architectural requirements.

Another example of a fixture of this type is the Seamlessline fixture, manufactured by Nippo Inc. This fixture utilizes a special standardized fluorescent lamp, which is manufactured to provide complete illumination of the tubular lamp body. Again, lamps can be installed to transition gradual curves depending upon the radius required and the most minimal lamp length. The lamp utilized in this type of fixture is of the "hot cathode" design. The lamp life is typically 12,000 hours, far less than the 50,000 hour cold cathode fluorescent lamp. This system is offered in straight lengths only.

Examples of systems that utilize tubular lamps and fixtures described in category #3 would include a cold cathode fluorescent lighting system manufactured by Cathode Lighting Systems. This is a component-based system which is comprised of custom-made lamps and lamp components that can either be field assembled or partially factory assembled utilizing standard electrical conduits, conduit connectors and wiring. The lamps can be fabricated to nearly any shape as desired, either straight, curved or bent. Each of the components is shipped separately to the installation site where a contractor installs the conduit and wiring between the lampholder and ballasts. These systems are almost always field-assembled.

A disadvantage of the system is that it is costly to install, and must be field-assembled from a variety of components (some provided by the lighting manufacturer, and some provided by the installing contractor). The lampholders retain and electrically connect the ends of adjacent lamps to the lamp ballast(s). This assures the spacing between lamp ends is always maintained at the proper dimension. On the other hand, because the lampholders retain the ends of adjacent lamps, there is little room for adjustment of the system if adjustment is required. The system is essentially built to a fixed dimension, and each lamp dimension and placement is dependent upon the adjacent segment. Any readjustment of lampholder positioning or spacing of an individual segment would either break the lamp(s), or require a redesign of the lamp(s) or system. Because field conditions vary, the ability to reposition the system and manipulate the spacing of the lamps ends would be advantageous.

Another cold cathode lighting system has been suggested where a continuous channel which contains the power supply and wiring for the lamp is custom-built to the exact shape of the lamp. An example of this system is manufactured by Neotek, Inc. The channel is assembled using a combination of extruded shapes and/or flat metal elements that can be factory-fabricated to form straight, curved or bent elements, to follow the shape of the custom-made lamp. These fixtures do not contain lampholders, which in almost all tubular light fixtures, connect the lamp (via a lamp base) to the power supply. Lamp base(s) and lampholder(s) type fixtures allow easy insertion and removal of a lamp, without any disassembly of the fixture. Rather, in the Neotek fixture, lamps are glued to the top portion of the snap-on channel and are connected to the power supply via a flexible conductor. The disadvantages of this product include the following:

A). A uniquely shaped or dimensioned custom channel must be factory-built for each unique lamp shape, requiring substantial labor, and if the fixture is dimensionally incorrect, it cannot be field-adjusted, it must be remade, along with the lamp.

B). Because the lamp is glued to the removable top portion of the channel and does not utilize traditional lamp bases and lampholders, if a lamp needs replacement, an entire new glued-together top channel and lamp assembly must be fabricated.

C). There are some limitations as to how small a radius or acute angle this type of (or any type of metallic channel-based) fixture can be manufactured to duplicate. These limitations are based on the physical properties of the material, the overall size of the channel and the limitations of the manufacturing techniques.

D). If field conditions dictate that a few fixtures in a predetermined array length require more separation between fixtures, these open-ended fixtures must be enclosed at each end, and like almost all linear fixtures (e.g. the fixture described in the '431 patent, which are always enclosed at each end, and allow concealed wiring from one fixture to the next, via standard electrical knockouts and standardized electrical fittings) will require external rerouting of the internal wiring, via electrical conduit, from one fixture to the next.

There is a desire for a fixture that can accommodate virtually any size or shape tubular lamp, essentially a "one size fits all" fixture. Also desired is an uncomplicated method of installing the desired fixture, such that a contractor can install the fixtures, install the lamps within the fixtures, and electrically connect the fixtures to each other, and electrical power, without any disassembly of the fixture whatsoever. Also desired is a fixture that can be field-adjusted or spaced at a variety of distances or orientations from each adjacent fixture without the requirement of building additional conduits or raceways to electrically connect one fixture to the next.

SUMMARY OF THE INVENTION

The present invention overcomes the problems of the prior art by providing a modular and flexible tubular lighting fixture system. The system combines pre-fabricated fixture elements connected by flexible elements to form a fluorescent light fixture which can be custom fit for easy installation. The system may advantageously include a plurality of lamps having any of a variety of lamp shapes, curves, colors, and/or sizes, which can be custom made to accommodate a particular location. The lighting system may be extremely easy to install when compared with other similar products.

In a preferred embodiment of the invention, a modular system for generating light has a plurality of fixtures. Each fixture has a plurality of casings electrically connected by a flexible special power cable, at least one tubular fluorescent lamp supported by the casings, and a ballast or ballasts for providing power to the lamp(s). Preferably, the fixtures are electrically connected together in parallel, using flexible power cord segments received at each end of the fixtures. In accordance with one aspect of the invention, the fixture can be mounted to a surface while completely assembled, electrically connected to adjacent fixtures and/or the primary circuit, with or without the lamp installed, and requires no disassembly during this process. In accordance with another aspect of the invention, each fixture functions as an independent element, and the elements combine to provide a continuous line of light. In a preferred embodiment, the fixtures do not need to be mechanically fastened to one another, or connected with additional electrical conduits to provide a safe interior wire passageway from one fixture to the next. Rather, an electrical connection is made externally from fixture to fixture via a series of flexible, modular, multi-pole electrical connectors.

In accordance with another aspect of the invention, a unique multi-conductor special power cable is used to connect the casings that enclose the lampholders and the lamp ballast(s). In a preferred embodiment of the invention, the special power cable is a molded polymeric cable that contains all of the conductors necessary to carry line-voltage electricity (and or the low-voltage DMX dimming signal) to the lamp ballast(s), and a special high-voltage conductor (or conductors) which carry the high-voltage electricity from the ballast(s) to the lamp(s). The special power cable is very flexible, it can be curved to any suitable radius, or bent to any suitable angle, or may be coiled to make the overall length of the fixture shorter. Unlike traditional flexible metallic conduit, the preferred special power cable will not unravel when subjected to forcefull extension and, unlike flexible non-metallic conduit, offers a smaller, more discreet footprint, and the special power cable will not "spring back" when curved into a shape, nor will it hold the memory of the coiled shape in which it is bulk packaged.

In accordance with an exemplary method for installing the lighting system, a custom lamp is pre-manufactured to a desired length or shape. The uncomplicated installation process may involve arranging a series of fixtures to match the approximate lamp shape or length, snapping the lamp into a lampholder on the fixture, positioning a lamp retaining clip around the lamp body, fastening the fixture to the mounting surface, and coupling the flexible electrical connectors to the adjoining fixture or power feed.

BRIEF DESCRIPTION OF THE DRAWINGS

Other objects and advantages of the invention will become apparent from the following detailed description and drawings which illustrate preferred embodiments of the invention, in which.

DETAILED DESCRIPTION OF PREFERRED EMBODIMENTS

Figure 1A:
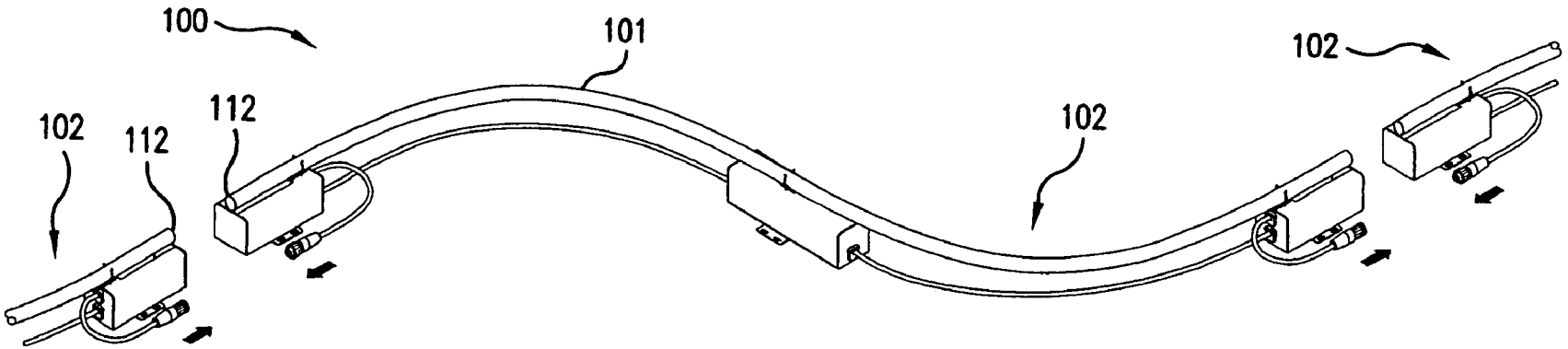
FIG. 1A is a perspective view showing one fixture constructed in accordance with a first exemplary embodiment of the invention with partial views of an adjacent fixture on each end of the fixture prior to mounting and electrical connection.

Referring now to the drawings, wherein like reference numerals indicate like elements, there is shown in FIGS. 1A-1B and 2A-2B a lighting system 100, or portions thereof, in accordance with a first exemplary embodiment of the present invention. The lighting system 100 includes a plurality of light fixtures, (composed of flexible special power cable segments which connect individual enclosures) 102 holding in-place sections of a tubular lamp (e.g. cold cathode fluorescent lamp) 101. The system 100 is intended for (but not limited to) use in indirect lighting environments, such as within a cove (not shown in FIGS. 1 or 2) to illuminate a ceiling.

Figure 1B:
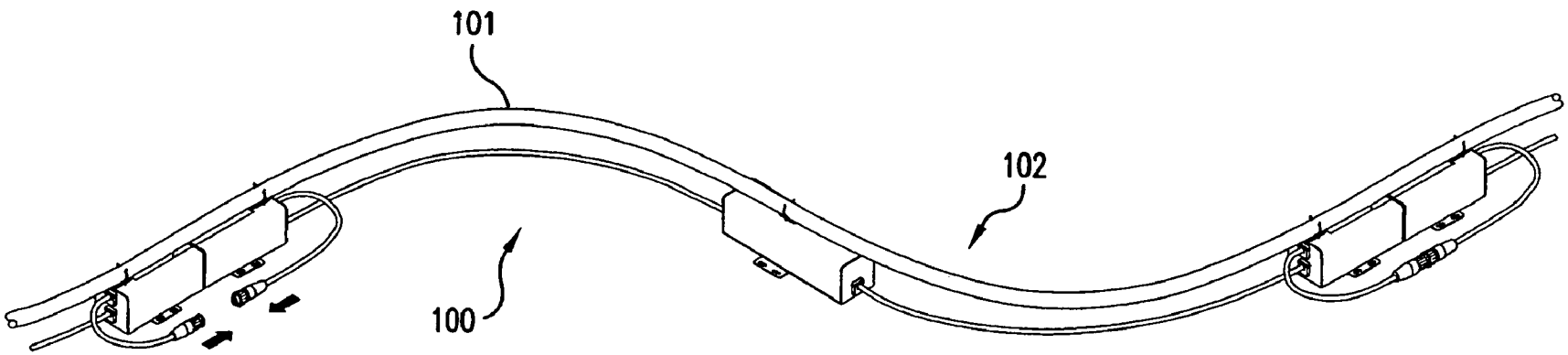
FIG. 1B is a perspective view of the complete fixture and partial adjacent fixtures shown in FIG. 1A, showing the leftmost segment prior to electrical connection, and the rightmost segment after electrical connection.
Figure 2A:
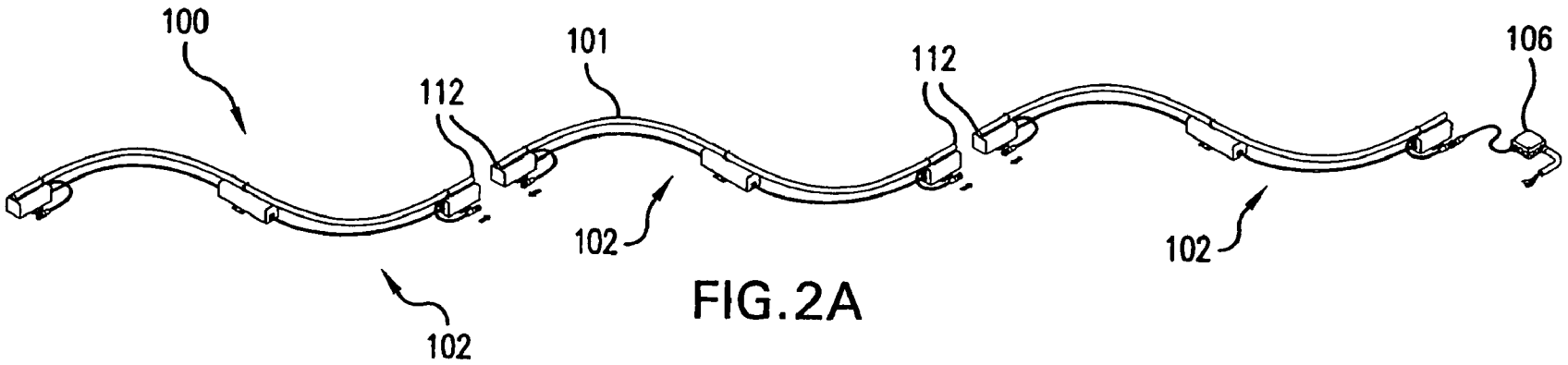
FIG. 2A is a perspective view of a three-fixture array composing a lighting system, shown just prior to mounting and electrical connection, constructed in accordance with the first exemplary embodiment of the invention.
Figure 2B:
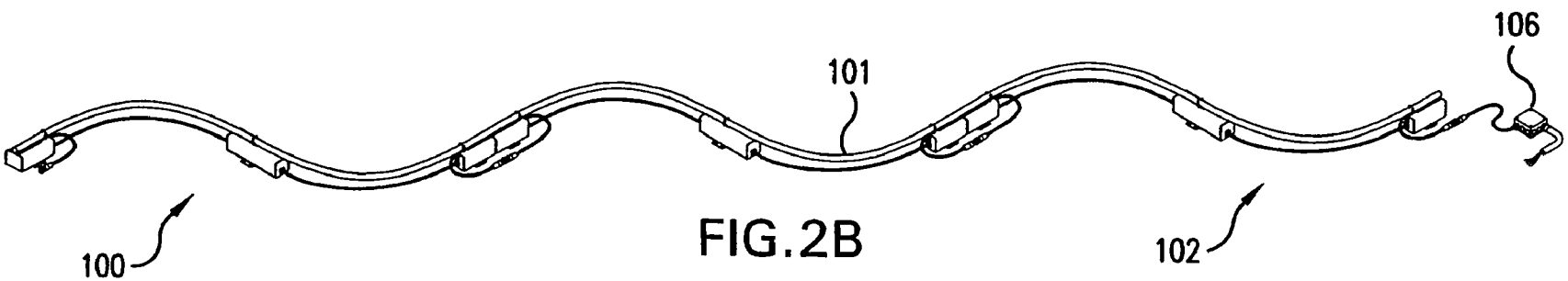
FIG. 2B is a perspective view of the three-fixture array of FIG. 2A shown after electrical connection.

FIG. 1A depicts one fixture 102 with portions of the adjacent fixtures 102, shown just prior to electrical connection and mounting of the fixtures 102. FIG. 1B shows the fixtures 102 of FIG. 1B as they would be mounted. The arrows at the left hand side of this Figure depict the electrical connection that is made, as shown by the fixture ends on the right hand side of the Figure. Similarly, FIG. 2A depicts a system 100 that includes three fixtures 102 and lamps 101 just prior to mounting and connection, while FIG. 2B shows the system 100 with the fixtures 102 having been connected.

Each lamp (e.g. cold cathode fluorescent lamp) 101 has a tubular light transmitting body with opaque or light-emitting ends 112. In the system 100 illustrated in FIGS. 1A-1B and 2A-2B, the lamps 101 are curved in an S-shape. In accordance with the invention, the lamps 101 may be of any suitable size and shape. Thus, each lamp 101 may be short or long, straight, curved, or bent depending upon the environment in which they will be installed and the desired illumination effect. The lamps 101 may be a stocked design, or may be custom built to meet the requirements of a particular design. Regardless of the size and shape of the lamps 101, the fixtures 102 may be designed to receive and operate with any lamp 101 as described herein. Thus, the fixtures 102 may be mass-produced and combined with tubular lamps (e.g. cold cathode fluorescent lamps) 101 of any suitable design to provide an off-the-shelf assembly that is easy to install, without the need for extensive labor involved in building a fixture to the exact shape of the lamp, or building a system in-place at the installation site to accommodate the unique lamp shapes.

Figure 3:
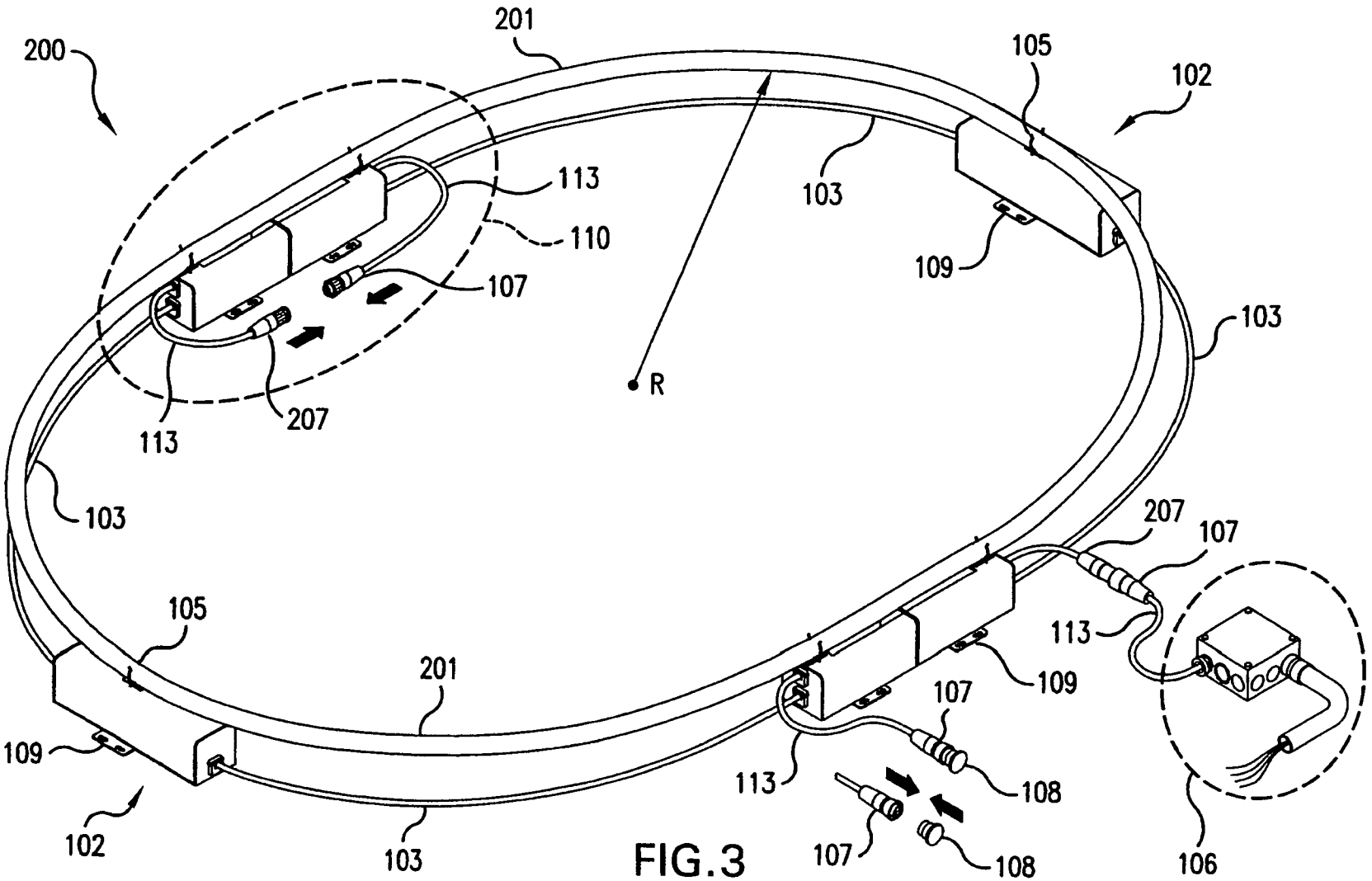
FIG. 3 is a perspective view of a two-fixture, circular lighting system constructed in accordance with a second exemplary embodiment of the invention.

As shown in FIG. 3, a perspective view of a second exemplary lighting system 200 (showing two fixtures 102), cold cathode lamps 201 may be curved to form a closed loop system 200 having a radius R. According to one aspect of the invention, the loop system 200 may have a smaller radius R than could be constructed with a conventional lighting system, while maintaining the benefits of easy installation. Another benefit that may be realized by the invention is that while the curved lamps 201 of the closed loop system 200 differ from the S-shaped lamps 101 used in the embodiment above, each of the other elements of the systems 100, 200 are identical. Thus, the fixtures 102 and special power cable 103 of the invention can be interchanged between the two custom-built lighting systems 100, 200.

Lamps 101, 201, etc. may be of any suitable customized shape and size in accordance with the invention, and therefore, the invention is not limited to the specific arrangements 100, 200 shown in the drawings. For purposes of simplification of discussion, most of the description herein will refer to the first exemplary lighting system 100 and its components, but it should be understood that the components may be interchangeable to form other modular lighting systems as desired. Even within a single system 100, the lamps 101 may comprise many shapes and sizes.

Exemplary systems may have either an individual fixture as shown in FIG. 1A or may be multiple fixtures, as shown in FIG. 2B, located back-to-back, and electrically connected to the adjacent fixture 102 to function as a continuous lighting array.

The modular fixtures 102, when mounted back-to-back as shown in FIGS. 1B and 2B, provide a system 100 that can maintain a continuous line of light achieving many benefits over conventional fluorescent lighting fixtures. For example, unlike many conventional lighting systems, the fixtures 102 do not need to be mechanically fastened to one another or affixed with additional conduits to provide a wireway or wire passageway from one fixture to the next. Most conventional fixtures must be disassembled and hard wired to the next fixture using standard electrical wiring and wire connectors (e.g. twist-on wire connectors). Some fixture manufacturers utilize modular connectors, which allow the electrical connection of one fixture to the next without the labor of cutting, stripping, and twisting the wires together and applying a twist-on wire connector to each connection. These fixtures are referred to colloquially as "plug and play" types. The typical modular connector (because of its design, UL listing, and the requirements of the National Electric Code) must reside, protected within the fixture(s) or raceway(s) where the hazard of the connector accidentally becoming unplugged or the hazard of unenclosed conductors is not an issue. Correspondingly, connection of the modular connectors requires at least a partial fixture disassembly during installation. In that case, the modular connections are fed through holes or passageways in each end or side of the fixture, and coupled before fixtures are reassembled and the lamps can be installed.

In accordance with the present invention, electrical connection between two adjacent fixtures 102 is made using the modular connectors 107, 207 (FIGS. 4A and 4B) located at the end of a cord segment 113 extending from each casing at the end of a fixture. Because of a high strength locking design and a cable jacket design and rating, the connection between fixture ends can reside on the outside of each fixture-end enclosure, providing a flexible electrical connection from one fixture 102 to the next, or to line voltage 106, at one end of the system 100. Accordingly, disassembly of the fixtures 102 during installation is not required to make these connections. As shown in the Figures, one of the modular connectors 107 is "female"-type connector 107 which can be mated to a "male" type connector 207 at an end of the adjacent fixture 102. This type of connection locks together and is quite flexible, allowing for quick and simple connection of fixtures and to the line voltage during installation and/or disassembly.

At one end of the lighting system 100, the modular connector 107 does not have a mate, as what would be the mating connector 207 is connected to a power source 106 (FIG. 2A). Accordingly, a cap 108 is used to prevent electrical problems of having an exposed unmated female modular connector 107. The cap 108 can be made of any approved resistant material, and preferably, it screws and locks into connection with the unmated end 107 or 207 (if applicable) to completely cover its end. The power source 106 can supply either 120 or 277 volts of electricity, which is converted by the ballast to the higher voltages required by the lamp(s) 101.

Figure 8:
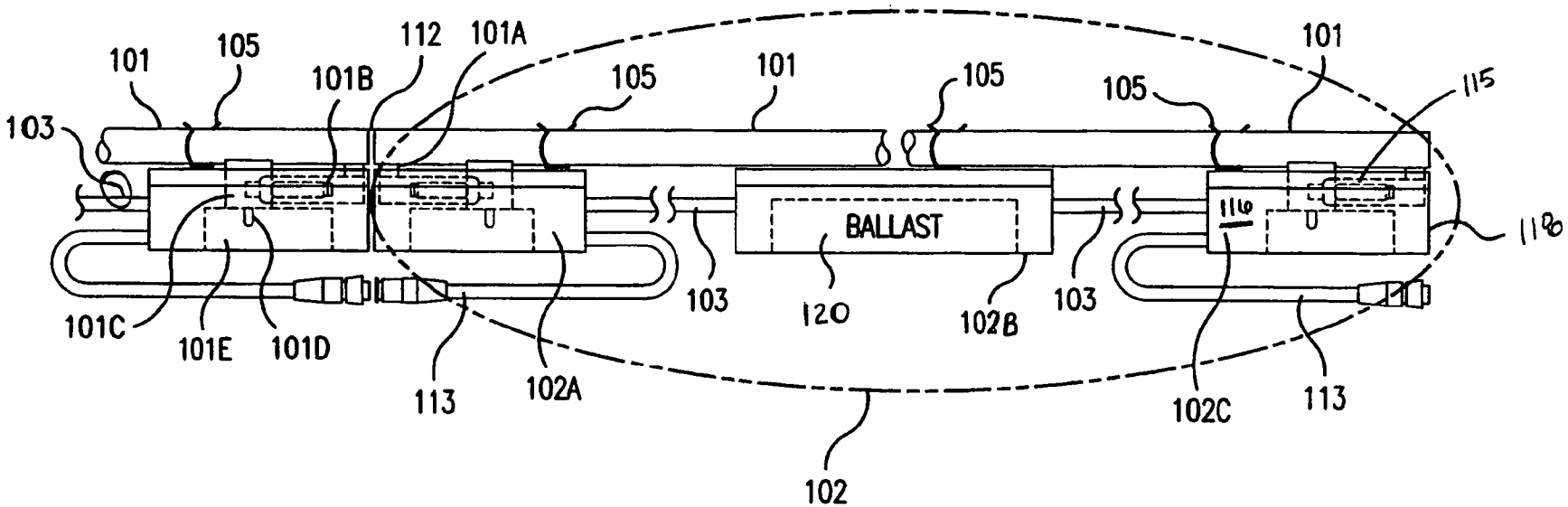
FIG. 8 is a side-view of an individual fixture and a partial view of an adjoining fixture in accordance with the invention.

As shown in FIG. 8, each fixture 102 is preferably composed of three casings 102*a*, 102*b*, 102*c*, although it should be understood that only two casings may also be utilized in accordance with the invention. Where three casings 102*a*, 102*b*, 102*c* are utilized, the middle casing may comprise a ballast 120. Alternatively, the ballast 102 could also be enclosed in either of the end enclosures 102*a* or 102*c*, along with the one of the lampholders 104 (FIG. 9) thereby eliminating the middle enclosure 102*b*. Each casing 102*a*, 102*b*, 102*c* may be made from lightweight aluminum extrusions which snap together. The casings 102*a*, 102*b*, 102*c* include a side plate 118, and a top cover 116 having openings 115 for the lampholders 104 (FIG. 9) within the fixture cover 116.

Figure 4A:
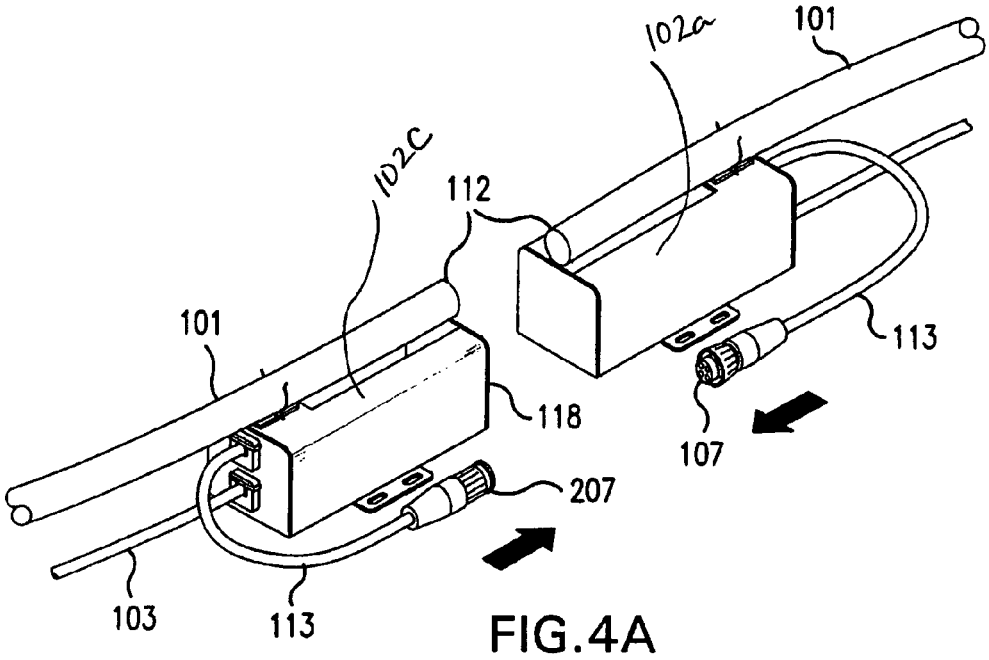
FIG. 4A is a perspective view of a two adjoining fixture ends (showing ends prior to mounting and electrical connection) for use in a lighting system in accordance with the invention.
Figure 4B:
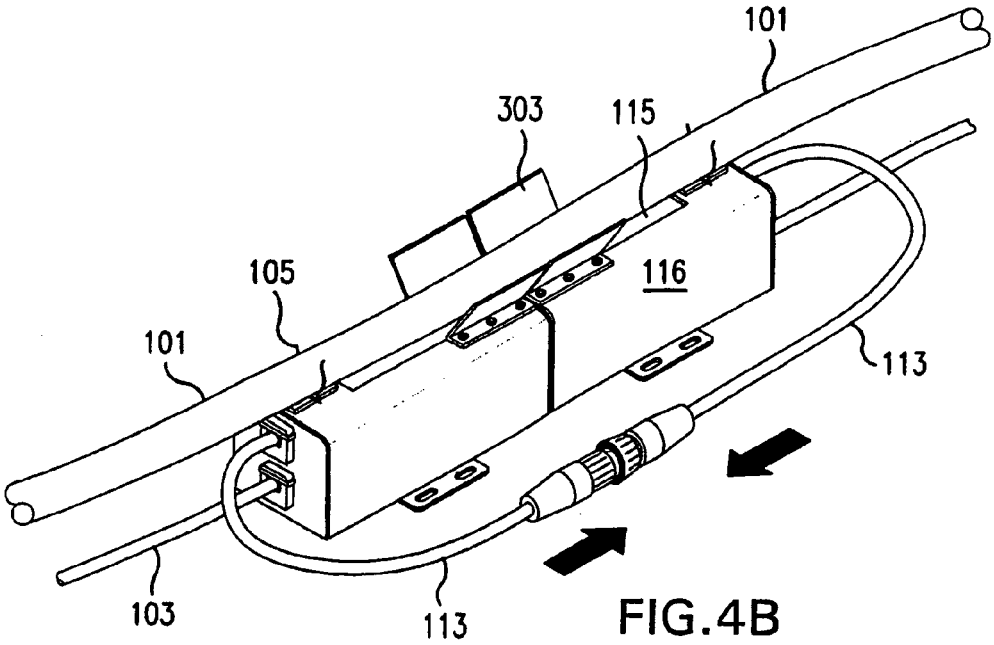
FIG. 4B is a perspective view of the two adjoining fixture ends shown in FIG. 4A, shown after electrical connection.
Figure 5:
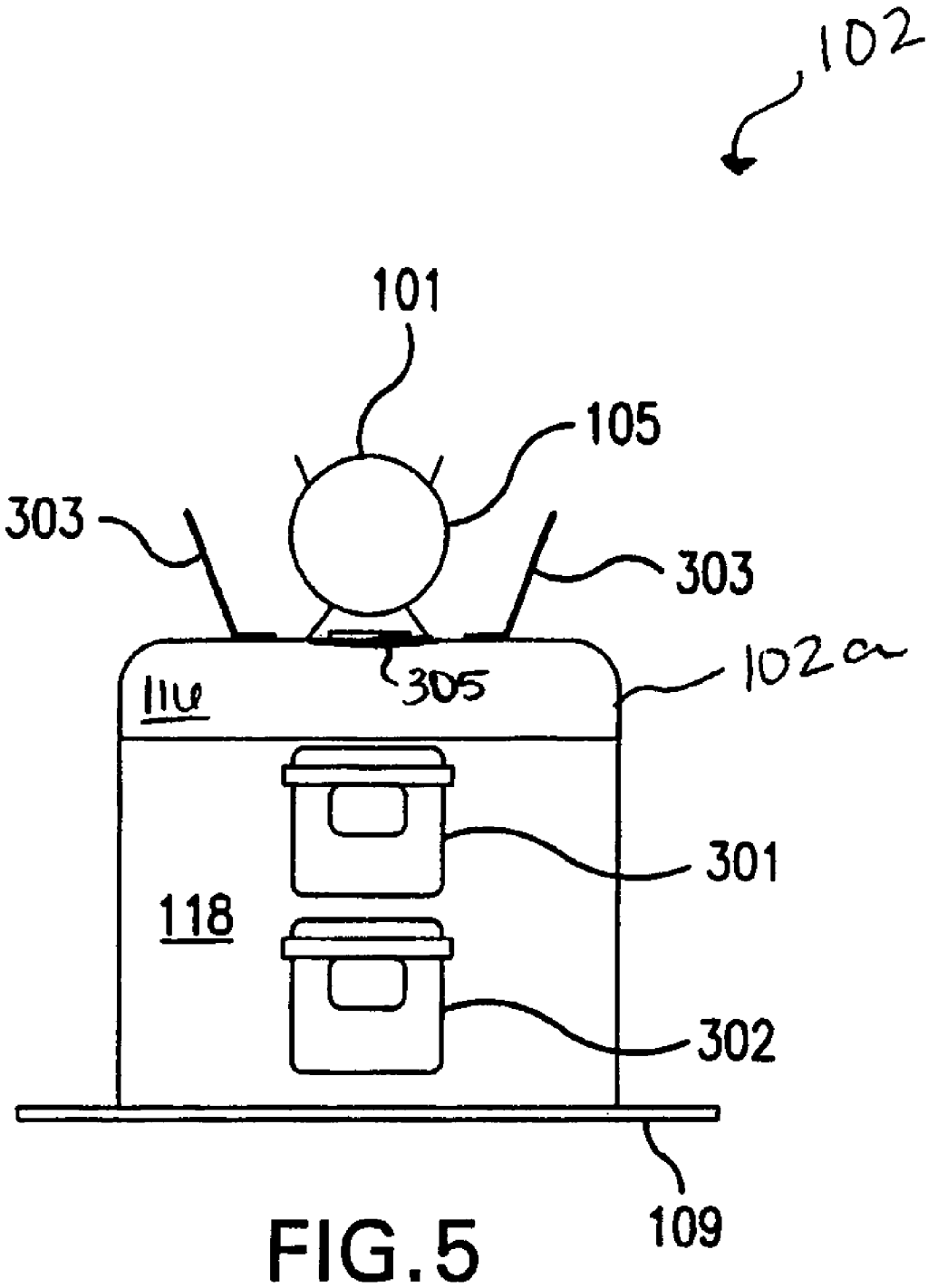
FIG. 5 is a back-side view of a fixture end for use in a lighting system in accordance with the invention.

In addition, as shown in FIGS. 4B and 5, each fixture casing 102*a* may have several reflectors 303 extending from the top cover 116. In a preferred embodiment, at least the casings 102*a*, 102*c* that form the fixture ends have one reflector 303 extending upward from each side of the opening 115 on the casing cover 116. Thus, the reflectors 303 are on either side of the lamp 101, specifically near the end 112 of the lamp tubing. Even though the gap between fully-illuminated adjacent lamp ends is minimal (0.125"-0.250"), there is still the possibility of a slight shadow appearing on an adjacent surface, especially if the surface is very close to the lamps. The reflectors 303 reflect and distribute the light in a random pattern away from the lamp ends 112. Used in this position, the reflectors 303 thereby serve to soften any potential shadowing effect caused by this minimal gap between two adjacent lamps 101.

Next, with reference to FIG. 5, a back side view of one of the exemplary fixture casings 102*a*, 102*c* at an end of the fixture 102 is shown. Each of the casings 102*a*, 102*c* that is coupled with another fixture casing 102*a*, 102*c* to form a fixture array has two cable/cord input/output openings 301, 302 on an end plate 118 of the fixture casing 102*a*, 102*c*. The first input/output 301 accepts the first cord 113 (FIGS. 4A and 4B) having a modular connection 107 at one end. The second input/output 302, located under the first input/output 301 on the end plate 118 accepts the special power cable 103 (FIGS. 4A and 4B). Each input/output 301, 302 should be designed to accept and hold in-place an associated cable/cord 113, 103 utilizing a suitable strain-relief device. The cord 103, and special power cable 113 can be pre-assembled to the casings, such as casing 102*a*, 402*e*. Also shown in the side view of FIG. 5 are the reflectors 303 and a wire clip 105, discussed below, used to hold the lamp tube 101 in place.

Preferably each casing enclosure 102*a*, 102*b*, 102*c* has a wire clip 105 (FIG. 6) extending outward and upward from a plate 305 attached to the fixture cover 116. The plate 305 may be mechanically attached to a top surface of the cover 116. The plate 305 may be fixed. The clip 105, which is captured between a machined or formed groove on the shorter width of the underside of the plate 305 and the top surface cover 116, may be allowed to slide side-to-side and rotated into a horizontal position so that it lays flat against the top surface cover 116. This side-to-side adjustability and flat-to-vertical hinging feature provide at least two benefits.

Firstly, the clip 105 can be orientated into a flat horizontal position for packaging of the fixture, and swiveled up and around the lamp body 101 during the appropriate stage of installation. Secondly, since the wire clip 105 can be adjusted left or right when receiving a lamp 101, the wire clip 105 can receive a lamp 101 even if the curvature or shape of the lamp creates a slight misalignment, and prevents insertion into clip 105 in its centered position.

Figure 6:
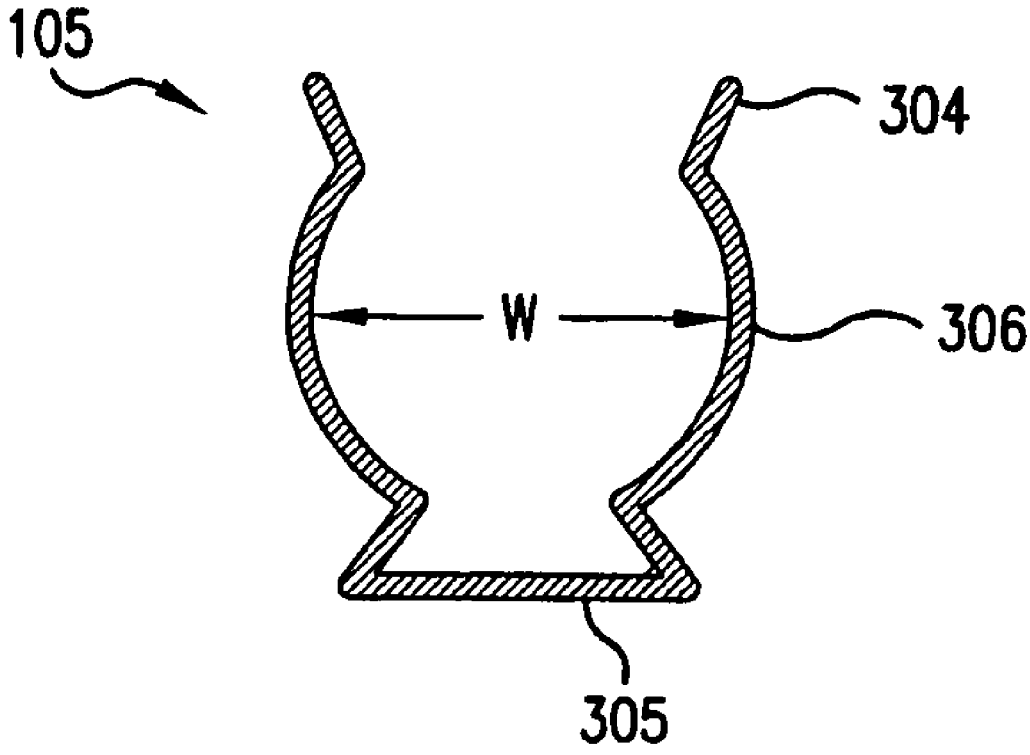
FIG. 6 is a cross-sectional view of a wire lamp clip utilized in accordance with the invention.

As shown in FIG. 6, the wire clip 105 is pre-assembled in a shape in which the maximum distance W is substantially the same as the diameter of the lamp 101 which will be held therein. At a tip 304 of the wire clip 105, the spacing should be less, such that some force needs to be applied to squeeze the lamp 101 into the wider area 306 of the clip. Once a lamp 101 is within this wider area 306 of the clip 105, it should also take force to remove the lamp 101 from the clip. Thus, the clip 105, in addition to the lampholders 104 (FIG. 8) serves to hold the lamp 101 properly in place at each fixture casing 102*a*, 102*b*, 102*c*.

Figure 7A:
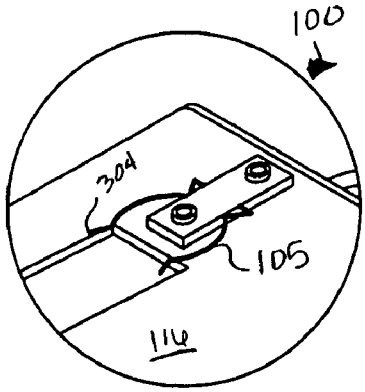
FIG. 7A depicts the wire retaining clip (laying flat in its packaging position) shown in FIG. 6.
Figure 7B:
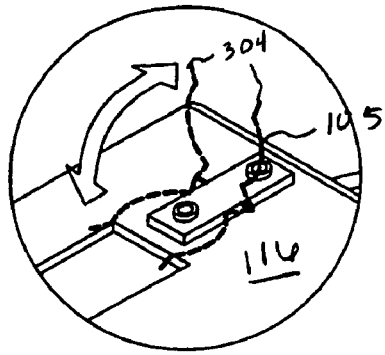
FIG. 7B depicts the swiveling action of the wire retaining clip shown in FIG. 6.
Figure 7C:
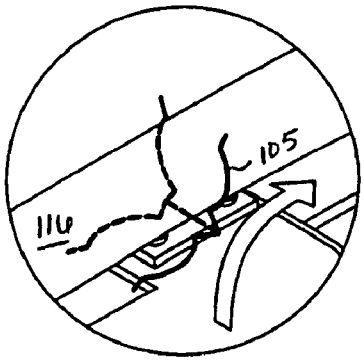
FIG. 7C depicts a first in a sequence of exemplary steps involved to utilize the wire retaining clip shown in FIG. 6.
Figure 7D:
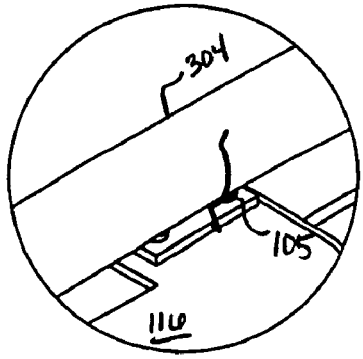
FIG. 7D depicts a second exemplary step for utilizing the wire retaining clip shown in FIG. 6.

FIGS. 7A-7D depict the wire clip 105 during various stages of installation for a system 100. As shown in FIG. A, the wire clip 105 is laying flat (for packaging). As shown in FIG. 7B, the wire clip 105 moves between a flat position against the fixture cover 116 and a vertical position. As shown in FIGS. 7C and 7D, and as discussed above, a small amount of force is used to lift the clip 105 from the flat to the vertical position to squeeze the lamp 101 through the wire clip tips 304 into a wider section of the clip 105 where the lamp 101 is firmly held in place with the clip 105 in a vertical position. The wire clip 105 can also swivel side-to-side while in the vertical position if required.

Figure 9:
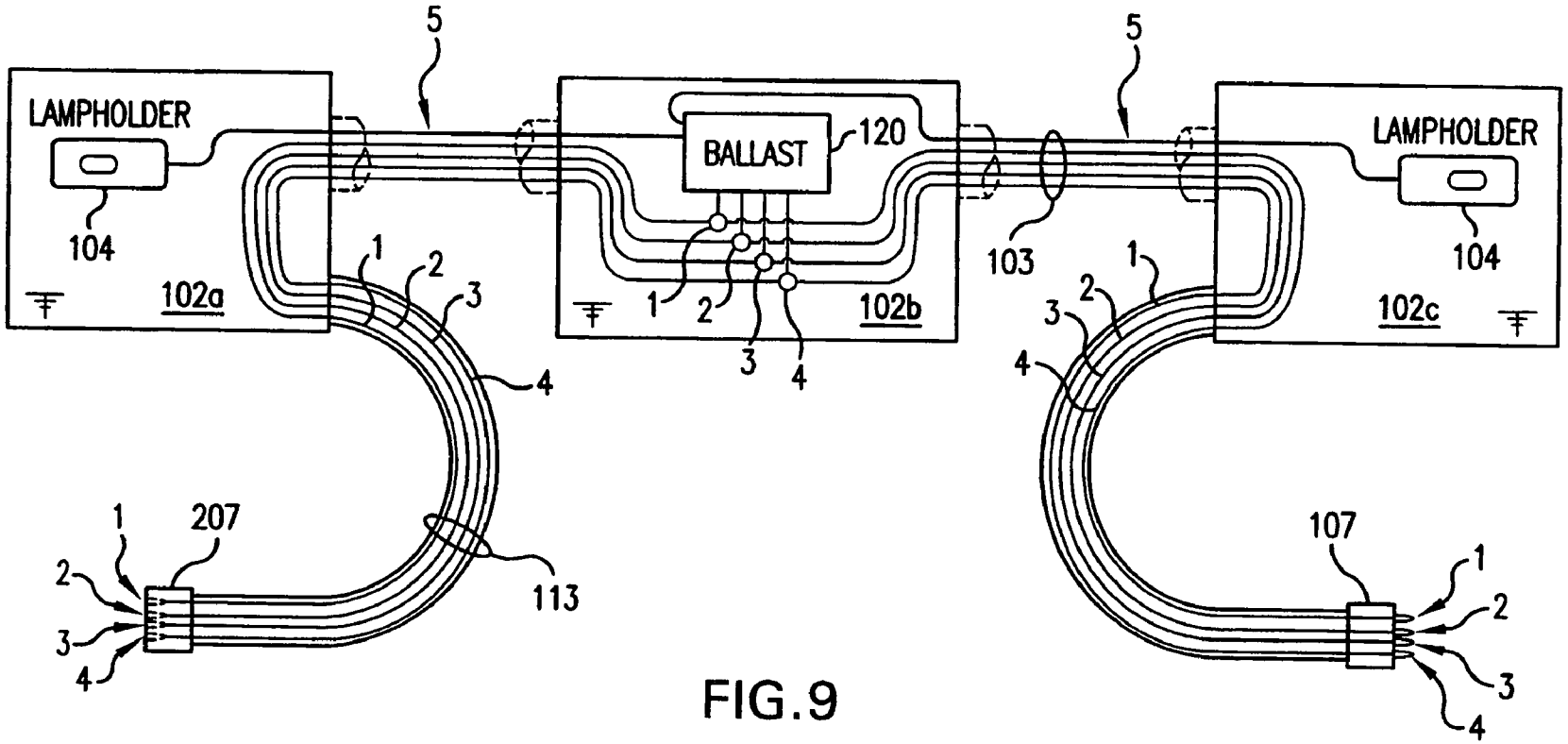
FIG. 9 is a simplified electrical and schematic diagram depicting wiring components (including enclosures, special power cables, modular connector cords, lampholders and ballast) assembled in accordance with an exemplary embodiment of invention.

With reference to FIGS. 8, 9, 11, and 12A-B, at the end of each lamp tube 112, the lamp 101 terminates in a flat surface 112. The underside of the lamp end includes a second smaller tubular element 101A fused at 90 degrees to the lamp 101. Fused to tubular element 101A is a third tube in parallel relationship to lamp 101, which contains the lamp electrode 101B. The lamp base 101C includes a hollow portion in which to accept the end of the electrode 101B, and a concave portion that cradles and is adhered to the underside of lamp 101, as described in U.S. Pat. No. 6,454,431 (assigned to Cathode Lighting Systems, Inc.) and incorporated herein by reference. The bottom surface of lamp base 101C is fitted with a tubular brass ferrule 101D, which is electrically connected to the lamp electrode 101B. A lampholder 101E is mounted to the bottom of the enclosure 102*a*, and contains a hollow portion with spring bronze retaining clips, which retain and electrically connect the ferrule 101D. The lampholders 101E are wired directly through the special power cable 103, discussed in detail below, to each of the ballast secondary leads as shown in FIG. 9.

As required by the National Electric Code, all luminaires must have suitable mounting provisions. Most channel-type fixtures of the type described above are fastened to a surface by removing the cover of the fixture and screwing or bolting through the bottom inner surface of the fixture to the mounting surface, and then replacing the enclosure cover and the lamp. Because non-disassembly of the fixture during installation is very desirable and minimizes labor, the casings 102*a*, 102*b*, 102*c* in the fixture may contain a mounting surface 109 for mounting the fixture 102 to a surface. In accordance with a preferred embodiment, the mounting surface 109 is a small plate that extends outwardly from a bottom of each side of the casing 102*a* and which has at least one opening for receiving a screw (see FIG. 11). Thus, each casing (and correspondingly each fixture) can be mounted in place, while the lamp is installed in the fixture.

Turning to FIG. 9, shown in simplified format is a schematic of the electrical connections and wiring for one fixture 102. The special power cable 103 runs among the three casings 102*a*, 102*b*, 102*c*, and includes five internal wires (shown here as 1, 2, 3, 4, and 5). The first wire 1 is a switched hot line wire. A second wire 2 is a dimmed hot line. Also inside the special power cable 103 are a neutral wire 3 and a ground wire 4. A fifth wire 5 runs from one lampholder to the ballast 120 and from the ballast 120 to a second lampholder 104. The cord segments (with male and female plugs) 113 that connect one fixture 102 to an adjacent one, contain the first four wires discussed above.

Figure 10:
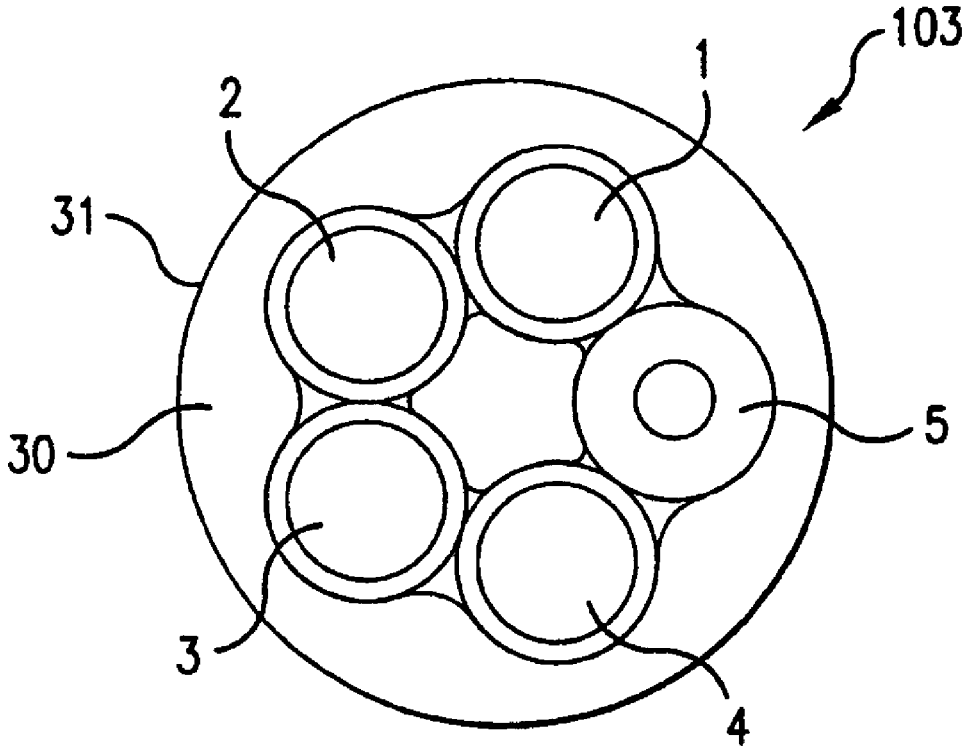
FIG. 10 is a cross-sectional view of a special power cable constructed in accordance with the invention.
Figure 11:
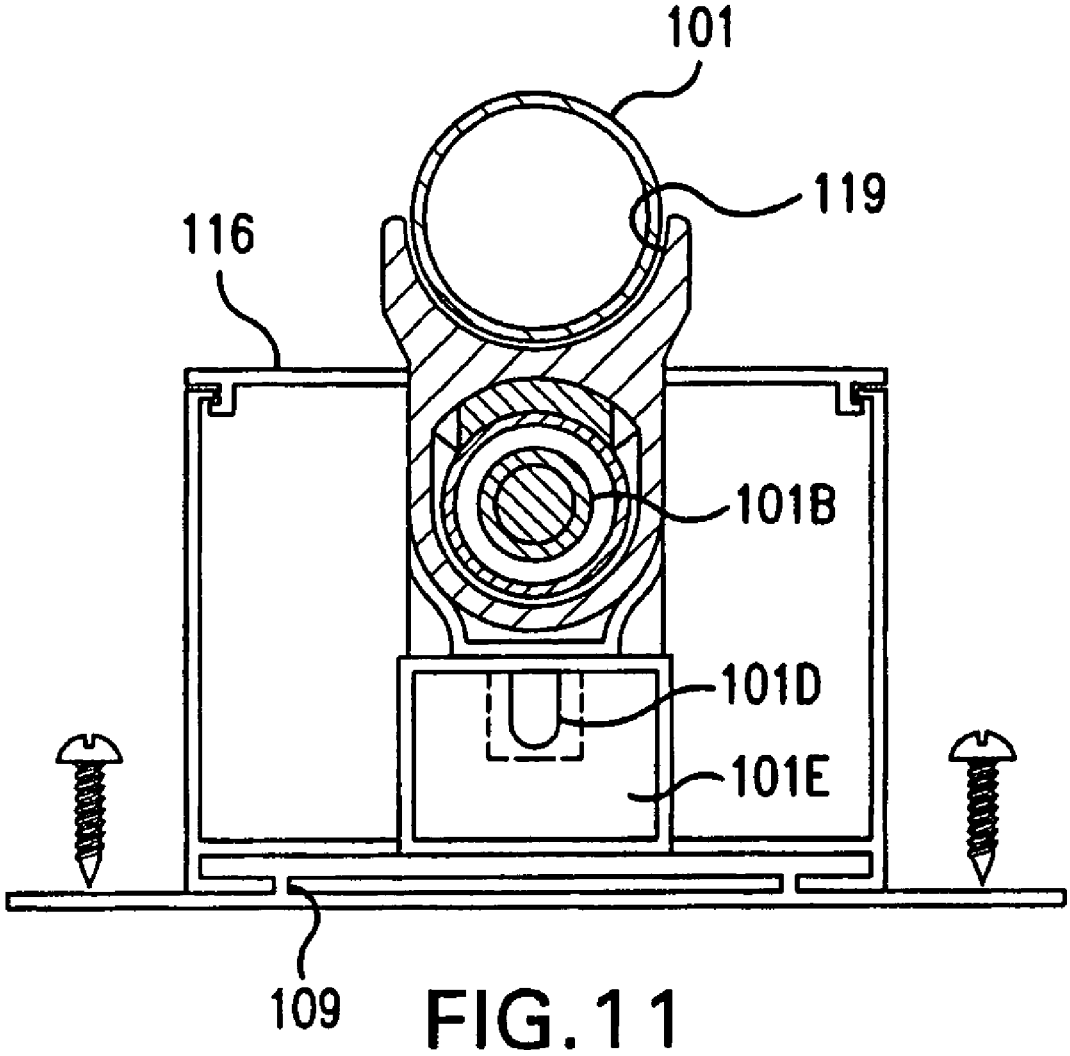
FIG. 11 is a cross-sectional view of the lamp base and lampholder assembled in accordance with an exemplary embodiment of the invention.
Figure 12B:
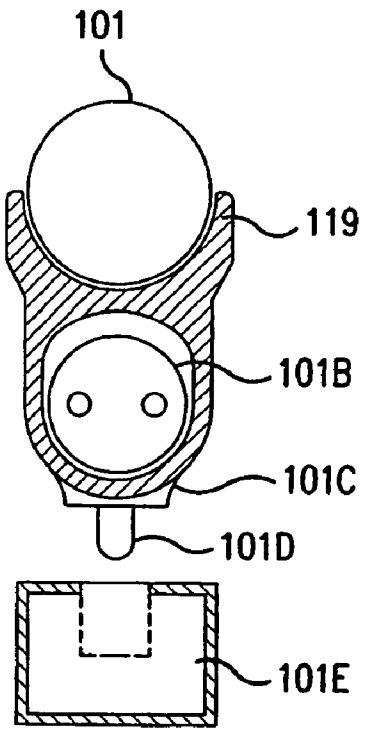
FIG. 12B is a cross-sectional and partially-transparent view of the lamp base and lampholder just prior to assembly in accordance with an exemplary embodiment of the invention.
Figure 12A:
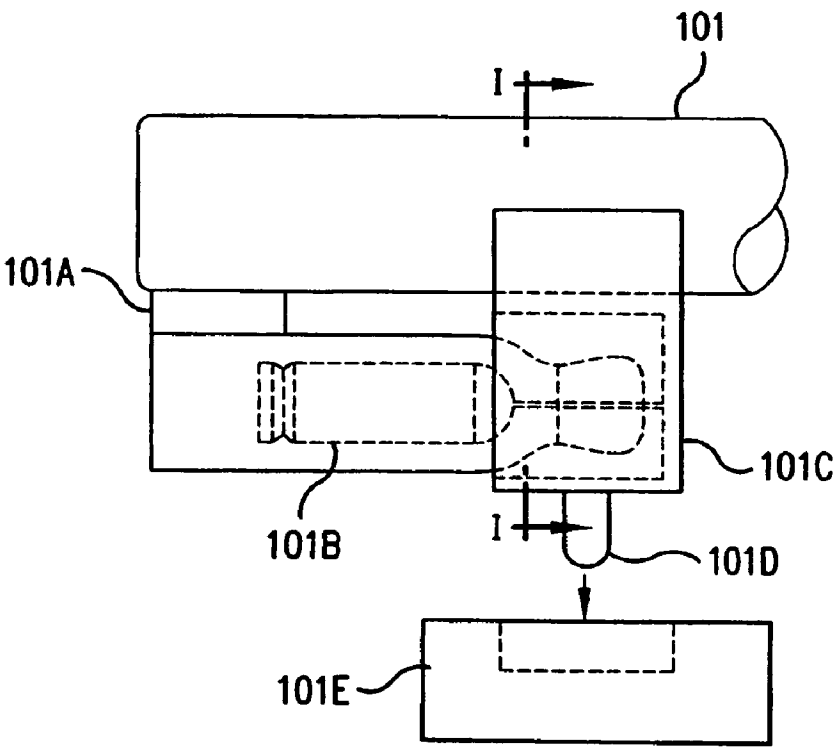
FIG. 12A is a side and partially-transparent view of the lamp base and lampholder just prior to assembly in accordance with an exemplary embodiment of the invention.
Figure 13E:
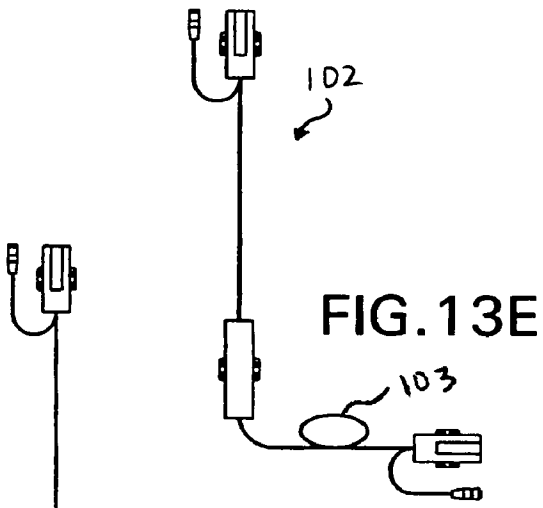
FIGS. 13A-F are diagrams showing how the flexible special power cable of FIG. 10 can be manipulated or shaped to manipulate the fixtures into almost any shape or length in accordance with the invention.
Figure 13F:
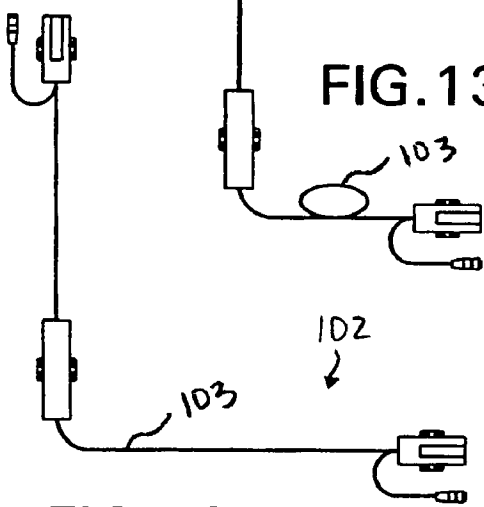
Figure 13A:
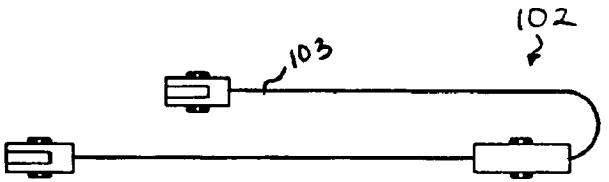
Figure 13B:
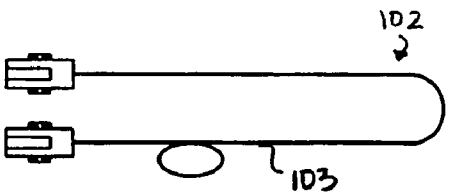
Figure 13C:
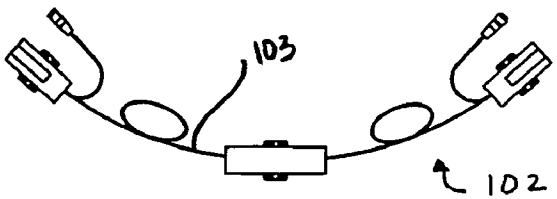
Figure 13D:
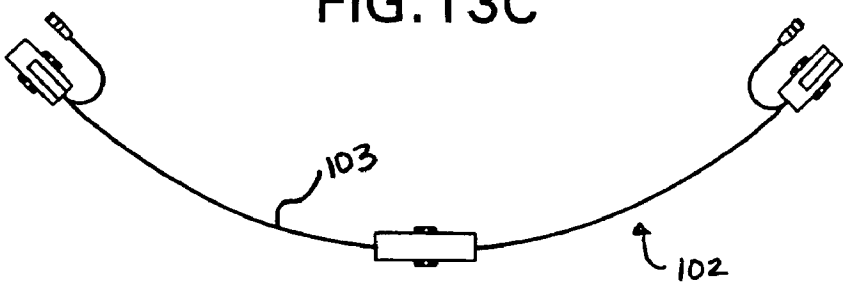

The special power cable 103 can be a flexible molded cable with a flexible jacket 31, and preferably includes all of the conductors necessary to power the ballasts 120 and correspondingly the lamps 101. The individual conductive wires 1, 2, 3, 4, 5 (FIG. 10) are further insulated using a suitable insulative material 30 inside the flexible jacket 31 and between the insulated jacket of each wire. In accordance with a preferred embodiment, the wire 5 (which connects the lampholders 104 to the ballast 120) will, in operation, carry 1000 volts of electricity, and the lower voltage wiring 1, 2, 3 and 4, in operation will carry no more than 600 volts (in practice this voltage will almost always be either 120 or 277 volts). The conductors 1, 2, 3 and 4 are sized to carry the maximum ampacity allowed by the design of the modular connectors 207 and 107. The insulation of the special power cable 103 and the conductors is a soft durometer polymer, and the stranding and gauge size of the copper wire is selected for maximum flexibility. Because the special power cable 103 is very flexible, it can conform easily to any suitable curvature or lamp design.

As shown in FIGS. 13A-13F, unlike flexible metallic conduits, the special power cable 103 can be curved to any suitable radius without damage (i.e., the flexible metallic will unravel when pulled or overbent). Accordingly, the special power cable 103 can be looped or curved to various radii, and otherwise manipulated to make the overall length of the fixture 102 shorter as necessary to fit the dimensions of a desired system. Unlike flexible non-metallic conduits, the special power cable will not "spring back" when curved into a shape, nor will it retain a curved shape from its coiled packaging, eliminating the possibility of lamp breakage due to torque on the lamp from the "springback" of the conduit. The cable jacket may be made from UV resistant material to prevent degradation caused by ultraviolet (UV) radiation emitted from the tubular lamp.

Figure 14A:
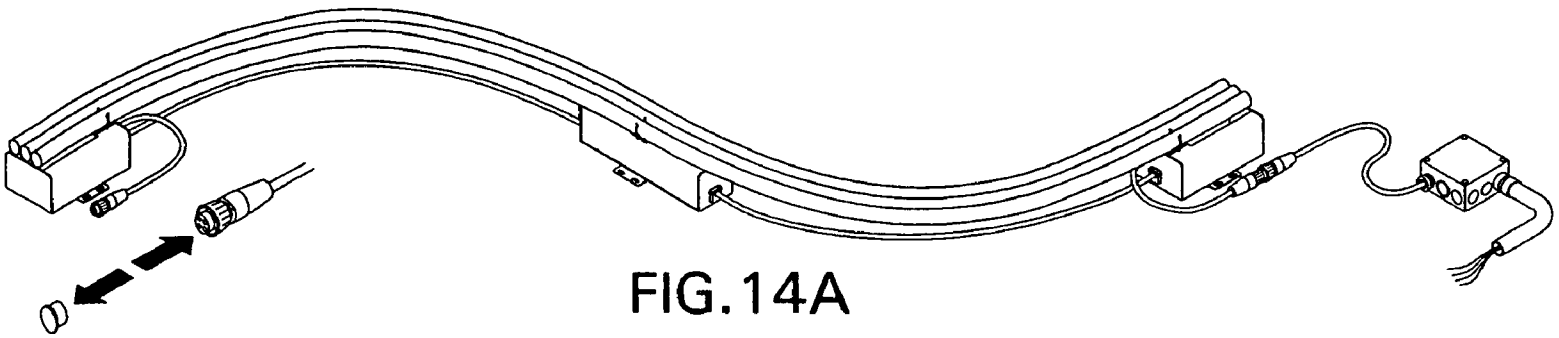
FIGS. 14A-C are schematic diagrams showing a 3-lamp assembly (three-color, e.g. red, green and blue, or any other variation of colors or whites, each color being separately controllable) constructed in accordance with the invention.
Figure 14B:
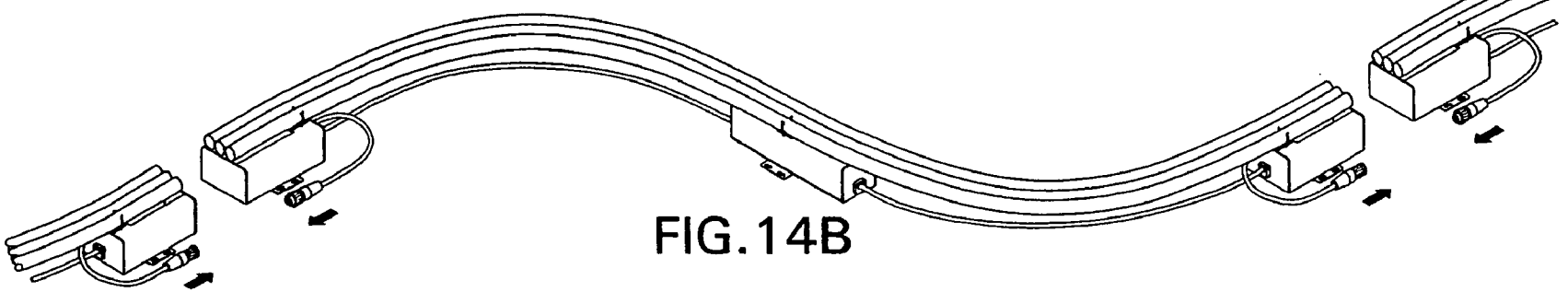
Figure 14C:
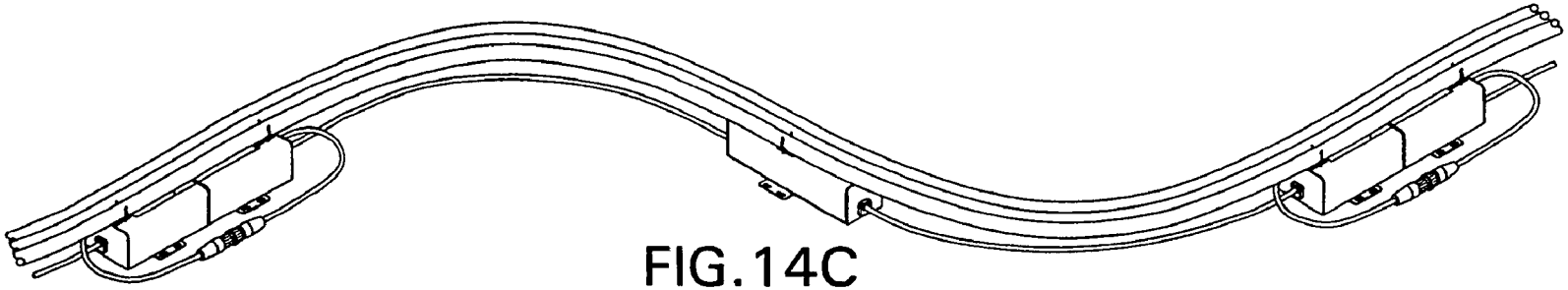
Figure 15A:
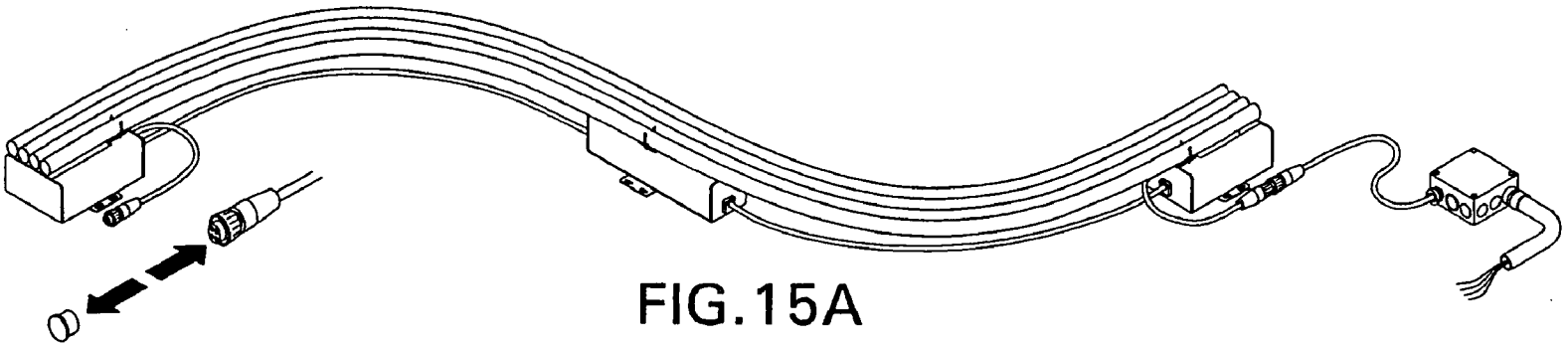
FIGS. 15A-C are schematic diagrams showing a 4-lamp assembly (four-color, e.g. Cyan, Magenta, Yellow and white or any other variation of colors or whites, each color being separately controllable) constructed in accordance with the invention.
Figure 15B:
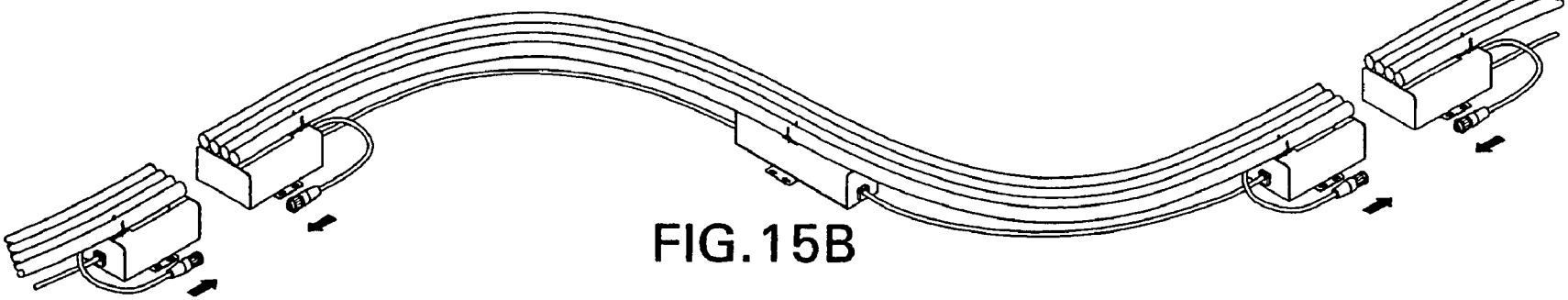
Figure 15C:
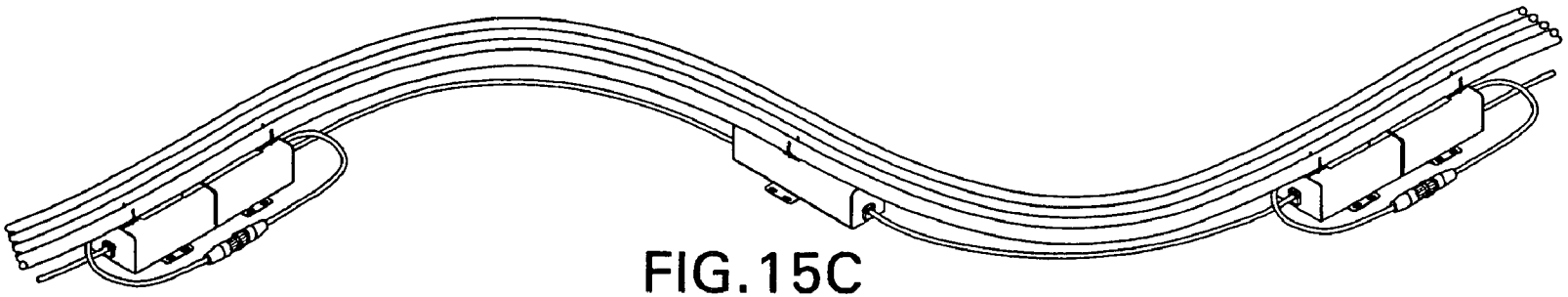

Other exemplary systems are depicted in FIGS. 14A-C and 15A-C. FIGS. 14A-C are schematic diagrams showing a 3-lamp assembly (three-color, e.g. red, green and blue, or any other variation of colors or whites) constructed in accordance with the invention. FIGS. 15A-C are schematic diagrams showing a 4-lamp assembly (four-color, e.g. Cyan, Magenta, Yellow and white or any other variation of colors or whites, each color separately controllable) constructed in accordance with the invention. It should be understood that these exemplary systems contain fixtures 102, special power cable 103, and cord 113 as discussed above, but each system may contain lamps of any shape, size, and color to meet the desired lighting characteristics for the system. The fact that the same fixtures 102 can be used for any of these exemplary systems is an important advantage of this invention.

Figure 16:
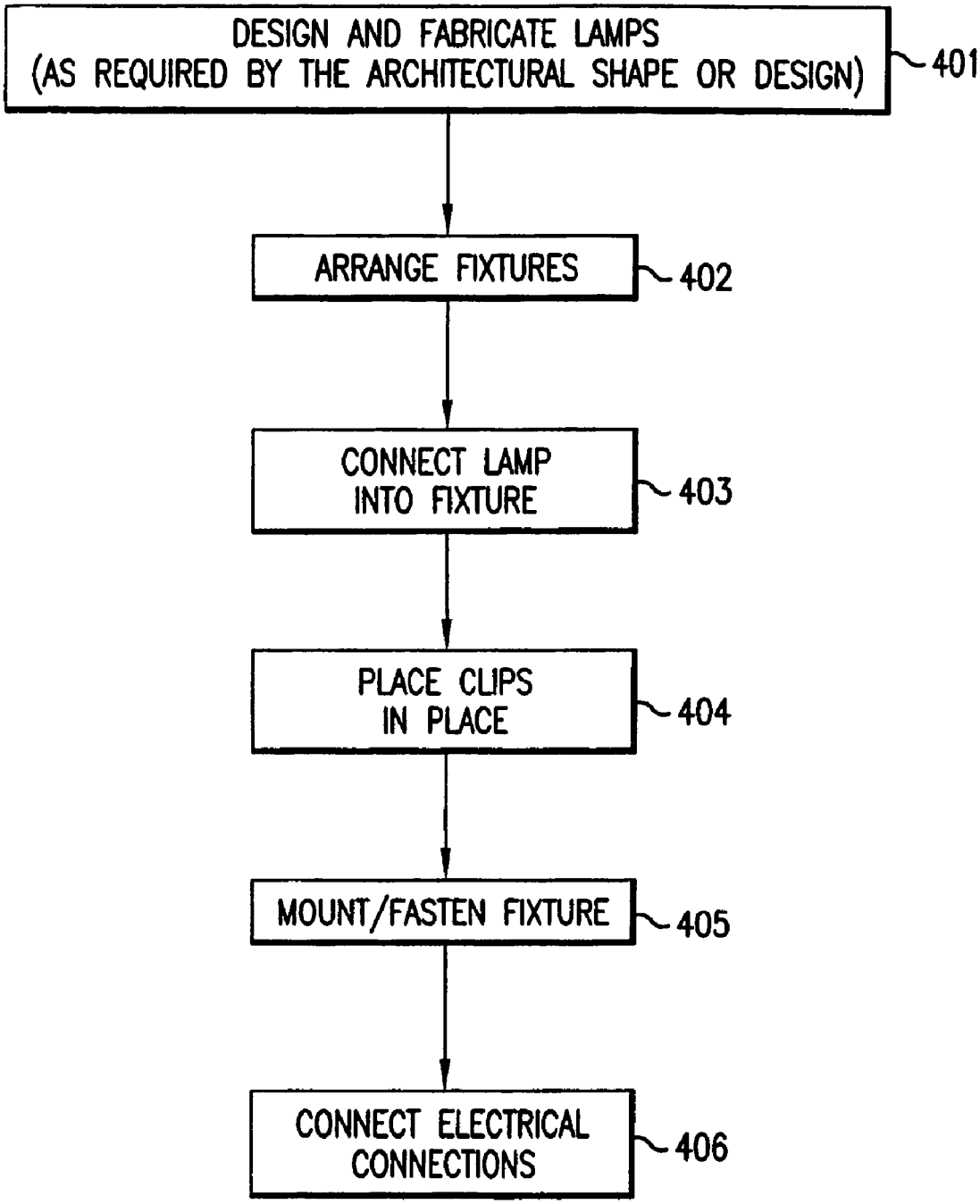
FIG. 16 is a flow chart depicting an exemplary method of installing a lighting system in accordance with the invention.

The easy installation of lighting systems, such as exemplary systems 100, 200, is another important advantage of the present invention. FIG. 16 depicts an exemplary method for installing a lighting system constructed in accordance with the invention. First, at step 401, lamps 101 are designed and fabricated to meet the particular lighting conditions necessary for a particular project.

Next, at step 402, fixtures 102 are arranged at the project site in the approximate shape of the lamps 101 to be installed. First and second sides of each special power cable section 103 extend from the middle casing 102*b* to each of the end casings 102*a*, 102*c*. Because the special power cable sections 103 are flexible, changes in location of the fixtures 102 is not critical as the special power cable 103 can be either adjusted or looped (to reduce the overall length) without sacrificing efficiency (see FIGS. 12A-12F).

In step 403, the lamps 101, 201 are snapped into place in the corresponding fixtures. Here, the lamp ends (which have integral lamp bases) are snapped into a lampholder within the casings at each end of the fixture. Next, at step 404, the wire clips 105 are swiveled 90 degrees up from horizontal and into place over the lamp body. As the system 100 begins to take shape, minor adjustments can be made in the positioning of the fixtures 102 until the overall system shape is created. At step 405, the fixtures are mechanically fastened using the mounting plates 109 attached to the underside of each casing (of which three comprise a fixture).

Finally, at step 406, once each lamp 101 and fixture is fastened in place, the electrical connections between each adjacent fixture 102, 202 are completed such that female modular connections 107 are mated with male modular connections 207 to form a continuous fixture array. In addition, the modular female connection end 107 of the lighting array is capped with a cap 108 at a first end, and connected to a power source 106 at a second end. Finally, power may be applied to the system 100.

The above description and drawings are only illustrative of preferred embodiments which can achieve the objects, features, and advantages of the present invention. It is not intended that the invention be limited to the embodiments shown and described herein. For example, the invention has been described with respect to cold cathode lamps, but it may be used with a variety of lighting systems, including standard fluorescent or other tubular lamps.

Modifications of the invention coming within the spirit and scope of the following claims are to be considered part of the present invention.

What is claimed as new and desired to be protected by Letters Patent of the United States is:

1. A modular lighting system comprising:

a plurality of fixtures, each fixture comprising: first and second lampholders respectively located at first and second ends of the fixture; a ballast for supplying power to the fixture; and a flexible power cable containing a plurality of conductors for carrying a line voltage and a secondary ballast voltage, the flexible power cable running between the ballast and the first and second lampholders; and a plurality of tubular fluorescent lamps received by said lampholders, wherein each of a first and a second of said plurality of fixtures are connected end-to-end by mating first and second flexible connectors respectively extruding from said first and second fixture.

2. The modular lighting system of claim 1, wherein each lampholder receives one lamp, by a single power-conducting contact protruding from a horizontal underside of the lamp.

3. The modular lighting system of claim 1, wherein the tubular fluorescent lamps are cold cathode lamps.

4. The modular lighting system of claim 1, wherein each lampholder assembly further comprises a swiveling clip receiving a body of a lamp mounted at least partially within the lampholder assembly.

5. The modular lighting system of claim 4, wherein each swiveling clip is designed to swivel from side-to-side as well as to swivel from a flat position on the lampholder assembly to an upward position extending over a top side of the lamp.

6. The modular lighting system of claim 1, wherein each lampholder assembly further comprises at least one reflector mounted near an end of a lamp that is received at the lampholder, the reflectors for reflecting light in a random pattern away from said lamp end.

7. The modular lighting system of claim 1, wherein said power cable comprises a molded polymeric cable containing conductors carrying up to 1000 volts, and voltages of 600 volts and below.

8. The modular lighting system of claim 7, wherein the length or curvature of each of said fixtures is adjustable, and wherein said power cable is flexible, such that it can be manipulated to increase or decrease said adjustable length or manipulated to conform to a variety of curvatures or shapes.

9. The modular lighting system of claim 1, wherein each fixture is designed to fit each of a plurality of possible sizes and shapes for said lamps.

10. The modular lighting system of claim 1, wherein said system comprises:

at least first and second lamps located adjacent one another and running parallel to one another; and at least third and fourth lamps located adjacent to one of said first and second lamps and running parallel thereto.

11. The modular lighting system of claim 10, wherein said first, second, third, and fourth lamps are of a first, second, third, and fourth color respectively, thereby creating a continuous array of light.

12. A power cable used in a lighting system, the cable comprising:

an outer casing comprising a flexible material;

first conductive wiring inside the outer casing, being rated for a maximum of 1000 volts, and carrying a secondary ballast voltage of up to approximately 1000 volts;

second conductive wiring inside the outer casing for carrying a primary voltage to the ballast, and to adjacent fixtures of approximately 600 volts or less; and insulation inside the outer casing for insulating the first and second conductive wiring, wherein said power cable is flexible, such that it can be manipulated to a desired length and shape, to conform to a shape, length, and curvature of an associated lamp.

13. The power cable of claim 12, wherein the insulation comprises a softer durometer polymer.

14. The power cable of claim 12, wherein the outer casing comprises a UV-resistant material.

15. A method of assembling a lighting system, the method comprising:

selecting a plurality of lamps having a desired length, shape, and size;

arranging a plurality of fixtures in a custom design to match the selected lamps, each fixture comprising at least one lampholder, a flexible cord connector for connecting the fixture to an adjacent fixture, a flexible power cable for carrying a line voltage and a secondary ballast voltage, and a power source;

snapping each lamp into a lampholder;

fastening the fixtures to a mounting surface; and coupling said connectors to one another to connect each fixture to an adjacent fixture.

16. The method of claim 15, further comprising securing said lamps using a swiveling lamp clip.

17. The method of claim 15, further comprising coupling one of said connectors at an end of said system to a power feed.

18. The method of claim 15, wherein the act of snapping a lamp into a lampholder comprises providing a single electrical pin extending vertically from a body of said lamp and lamp base into said lampholder into electrical contact with said lampholder.

19. The method of claim 15, wherein the flexible connector comprises a first cord segment extending from the fixture, the cord having a first mating part and a second cord segment extending from the adjacent fixture and having a second mating part for connecting with the first mating part.

20. The method of claim 15, wherein arranging the plurality of fixtures comprises adjusting at least one power cable in a fixture for shortening a length of that fixture.

21. A power cable for a lighting system comprising:

a flexible casing;

at least one wire inside the casing for carrying line-voltage electricity to the input of at least one ballast; and at least one high voltage wire inside the casing for supplying power from the output of said at least one ballast to at least one tubular lamp.

22. The method of claim 15, further comprising the step of applying said line voltage and said secondary ballast voltage to said flexible power cable, and thereby applying said line voltage and said secondary ballast voltage to and from a ballast, respectively.

* * * * *